US009981363B2

(12) United States Patent
Liau

(10) Patent No.: US 9,981,363 B2
(45) Date of Patent: May 29, 2018

(54) OPEN WRENCH

(71) Applicant: Jia-Guann Liau, Taichung (TW)

(72) Inventor: Jia-Guann Liau, Taichung (TW)

( * ) Notice: Subject to any disclaimer, the term of this patent is extended or adjusted under 35 U.S.C. 154(b) by 339 days.

(21) Appl. No.: 14/753,037

(22) Filed: Jun. 29, 2015

(65) Prior Publication Data

US 2016/0375558 A1 Dec. 29, 2016

(51) Int. Cl.

| | |
|---|---|
| ***B25B 13/08*** | (2006.01) |
| ***B25B 13/04*** | (2006.01) |
| ***B25B 13/48*** | (2006.01) |

(52) U.S. Cl.

CPC ..... *B25B 13/08* (2013.01); *B25B 13/04* (2013.01); *B25B 13/481* (2013.01)

(58) Field of Classification Search

USPC ..... 81/119

See application file for complete search history.

(56) References Cited

U.S. PATENT DOCUMENTS

| | | | | | |
|---|---|---|---|---|---|
| 198,398 | A * | 12/1877 | Lester | B25B 13/08 | 100/1 |
| 2,619,862 | A * | 12/1952 | Trypanis | B25B 13/08 | 81/119 |
| 6,318,216 | B1 * | 11/2001 | Eggert | B25B 13/04 | 81/124.3 |
| 8,443,701 | B1 * | 5/2013 | Liau | B25B 13/04 | 81/119 |
| 2013/0167692 | A1 * | 7/2013 | Liau | B25B 13/04 | 81/119 |

* cited by examiner

*Primary Examiner* — Hadi Shakeri

(57) ABSTRACT

An open wrench includes a head having a handle and a driving portion which has an opening. A first layer, a second layer, a third layer and a fourth layer are formed on each of the top and the bottom of the driving portion. The first layer and the second layer are located along the U-shaped opening of the head. The top face of the second layer is smaller than that of the first layer. The third layer extends from the middle portion of the first layer, and the fourth layers extends from the middle portion of the second layer. The top face of the fourth layer is smaller than that of the third layer. The open wrench is light in weight and strong in structure, and is able to output significant torque to objects.

11 Claims, 13 Drawing Sheets

B-B

C-C

A-A

B-B

C-C

OPEN WRENCH

BACKGROUND OF THE INVENTION

1. Fields of the Invention

The present invention relates to an open wrench, and more particularly, to an open wrench with less material required while the strength is maintained.

2. Descriptions of Related Art

The conventional open wrench is disclosed in FIG. 21 and comprises a head 60 having a handle 61 and a driving portion 62 whose thickness is thicker than that of the handle 61. The thicker driving portion 62 is heavy. FIG. 22 shows another open wrench which comprises a head 70 having a handle 71 and a driving portion 72 which includes a first layer 721 and a second layer 722 formed thereon. The thickness of the first layer 721 is the same as that of the handle 71. The second layer 722 is located along the opening of the head 70. The second layer 722 protrudes from the first layer 721. The head 70 meets the standard of German Standard DIN 3113. However, the volume of the head 70 is smaller than the head 60, the wrench cannot output satisfied torque.

The present invention intends to provide an open wrench to eliminate the shortcomings mentioned above.

SUMMARY OF THE INVENTION

The present invention relates to an open wrench and comprises a head having a handle and a driving portion which has an opening. A first layer, a second layer, a third layer and a fourth layer are formed on each of the top and the bottom of the driving portion. The first layer and the second layer are located along the U-shaped opening of the head. The top face of the second layer is smaller than that of the first layer. The third layer extends from the middle portion of the first layer, and the fourth layers extends from the middle portion of the second layer. The top face of the fourth layer is smaller than that of the third layer.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
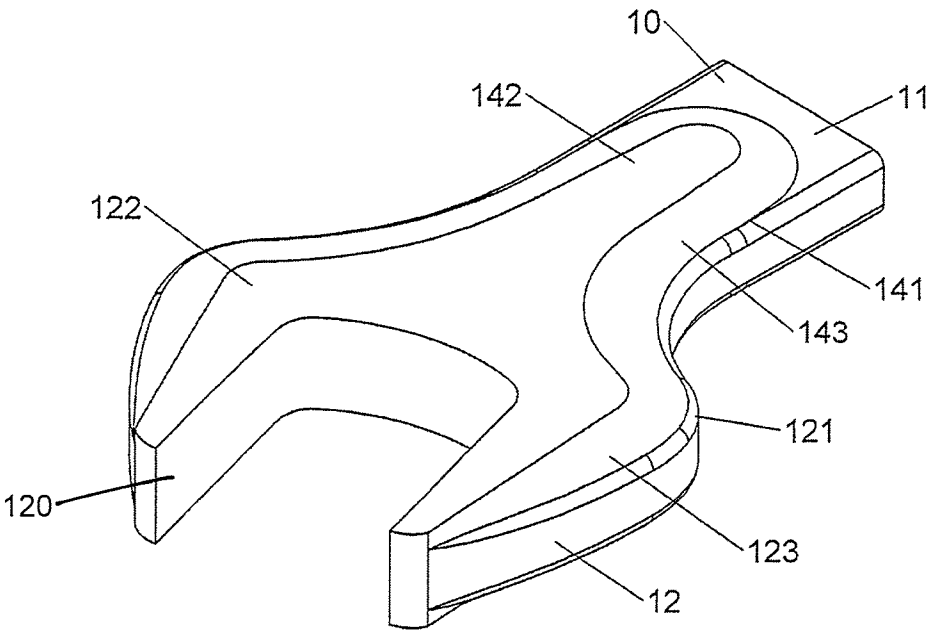
FIG. 1 is a perspective view to show the driving portion of the open wrench of the present invention.

Referring to FIGS. 1 to 4, the open wrench of the present invention comprises a head 10 which has a handle 11 and a driving portion 12 which has a U-shaped opening 120 defined through a front end, a top and a bottom of the head 10. A first layer 121 and a second layer 123 are formed on each of the top and the bottom of the driving portion 12. The second layer 123 is formed on the first layer 121. The first and second layer 121, 123 are located along the opening 120 of the head 10. The second layer 123 has a first top face 122 defined in a top thereof, and the first top face 122 is a flat face. The first layer 121 is integrally formed on the flat face of the driving portion 12. The periphery of the second layer 123 extends and is connected to the first top face 122 inclinedly. The cross sectional shape of the second layer 123 has two sides and each side is a straight side. The area of the first top face 122 is smaller than the area of the second layer 123, and the area of the second layer 123 is smaller than the area of the top of the first layer 121. A third layer 141 extends from the middle portion of the first layer 121 and toward the handle 11. A fourth layer 143 extends from the second layer 123 and toward the handle 11. The fourth layer 143 is located on the third layer 141. The fourth layer 143 has a second top face 142 defined in the top thereof, and the second top face 142 extends toward the handle 11. The second top face 142 is a flat face. The fourth layer 143 is integrally formed on the third layer 141. The third layer 141 is integrally formed on the flat face of the handle 11. The first and second top faces 122, 142 are located on the same plane and form a Y-shaped arrangement. The periphery of the fourth layer 143 extends and is connected to the second top face 142 inclinedly. The cross sectional shape of the fourth layer 143 has two sides and each side is a recessed and curved side. The area of the second top face 142 is smaller than the area of the bottom of the fourth layer 143. The area of the bottom of the fourth layer 143 is smaller than the area of the bottom of the third layer 141.

Figure 2:
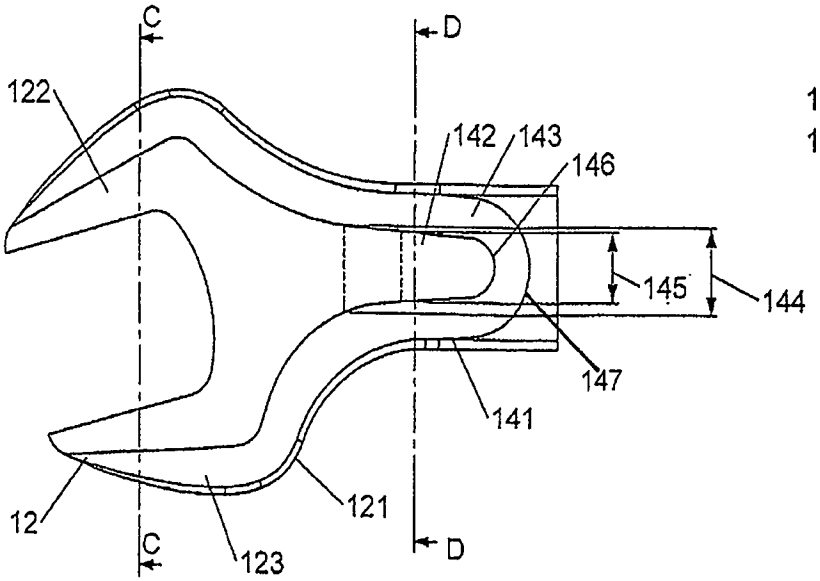
FIG. 2 is a top view of the driving portion of the open wrench of the present invention.

As shown in FIG. 2, the first top face 122 is connected to the second top face 142 at a portion thereof having a first width 144. The middle portion of the second top face 142 has a second width 145 which is smaller than the first width 144. The second top face 142 has a first curved portion 146 formed at the distal end thereof, and the diameter of the first curved portion 146 is smaller than second width 145. The bottom of the fourth layer 143 has a second curved portion 147 formed at the distal end thereof, and the diameter of the second curved portion 147 is larger than the diameter of the first curved portion 146. The first and second curved portions 146, 147 share a common center.

Figure 4:
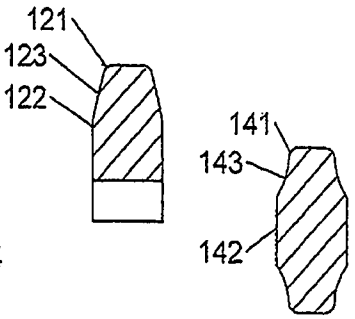
FIG. 4 is a cross sectional view taken along line D-D in FIG. 2.
Figure 3:
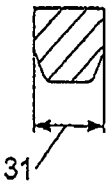
FIG. 3 is a cross sectional view taken along line C-C in FIG. 2.

As shown in FIGS. 3 and 4, first distance 31 is defined between the two respective first top faces 122 of the top and bottom of the driving portion 12. The cross sectional shape of the second layer 123 has two sides and each side is a straight side. The cross sectional shape of the fourth layer 143 has two sides and each side is a recessed and curved side.

Figure 5:
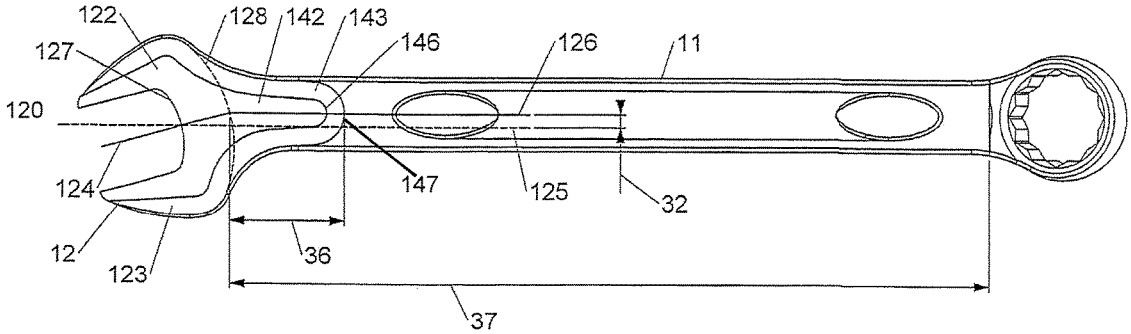
FIG. 5 is a top view of the open wrench of the present invention.

As shown in FIG. 5, the bottom of a first curved face 127 of the opening 120 of the driving portion 12 has a bisectional line 124 passing through the central point of the first curved face 127. A reference line 125 which is parallel to the axial line 126 of the handle 11 passes through the central point of the first curved face 127. An angle of 15 degrees is defined between the bisectional line 124 and the reference line 125. Namely, the opening 120 has a first curved face 127 defined in the inner end thereof, a reference line 125 which is parallel to the axial line 126 of the handle 11 passes through the central point of the first curved face 127 and intersects the bisectional line 124 at the central point of the first curved face 127. An imaginary second curved face 128 is defined at the intersection between the first layer 121 and the handle 11. The first and second curved faces 127, 128 are similar and share a common center. The bisectional line 124 intersects the axial line 126 at the center of the second curved face 128. A shift distance 32 is formed between the reference line 125 and the axial line 126. Because of the shift distance 32, the user can use the open wrench in a narrow space to rotate the object 50 without being interfered by other objects. A distance between an intersection point between an axial line 126 of the handle 11 and the second curved face 128 to an intersection point between the axial line 126 and the distal end of the fourth layer 143 is defined as the second distance 36. The ratio between the second distance 36 to the length 37 of the handle 11 is less than 0.5. The ratio between the second distance 36 to the length 37 of the handle 11 is between ⅓ to ⅙. Preferably, the ratio is 1.6.

Figure 6:
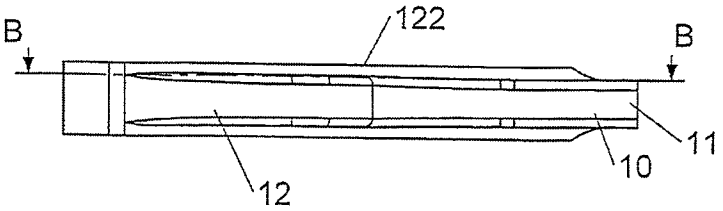
FIG. 6 is a side view of the driving portion of the open wrench of the present invention.
Figure 7:
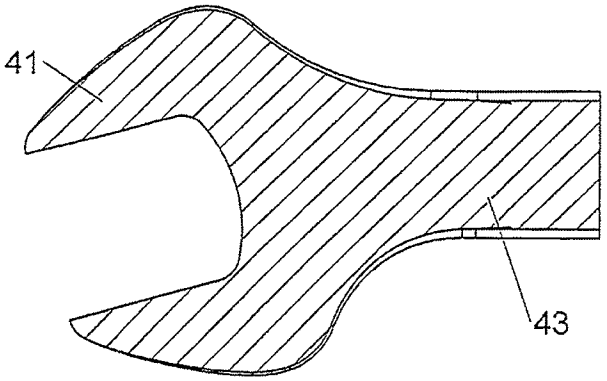
FIG. 7 is a cross sectional view taken along line B-B in FIG. 6.
Figure 8:
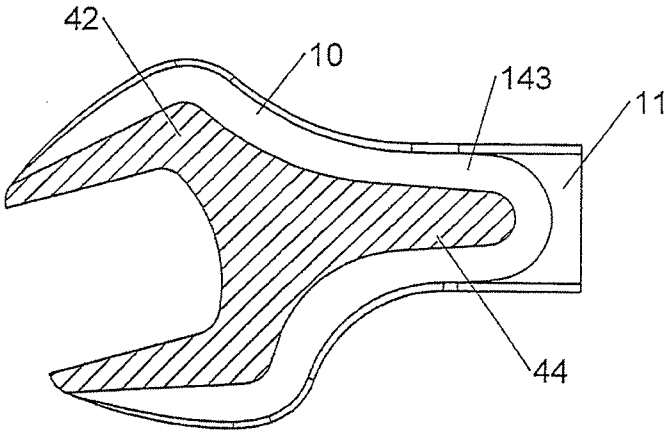
FIG. 8 is a cross sectional view of the top of the head of the open wrench of the present invention.

As shown in FIGS. 6 to 8, the first top face 122 protrudes from the first layer 121. The area 42 of the first top face 122 is smaller than the area of the top 41 of the first layer 121. The area 42 of the first top face 122 is ⅓ to ⅔ of the area of the top 41 of the first layer 121. The second layer 123 is connected between the top 41 of the first layer 121 to the first top face 122. The cross sectional shape of the second layer 123 has two sides and each side is a straight side or a concaved and curved side. The area 44 of the second top face 142 is smaller than the area of the top face 43 of the third layer 141. The fourth layer 143 is connected between the top face 43 of the third layer 141 and the area 44 of the second top face 142. The cross sectional shape of the fourth layer 143 has two sides and each side is a straight side or a recessed and curved side.

Figure 9:
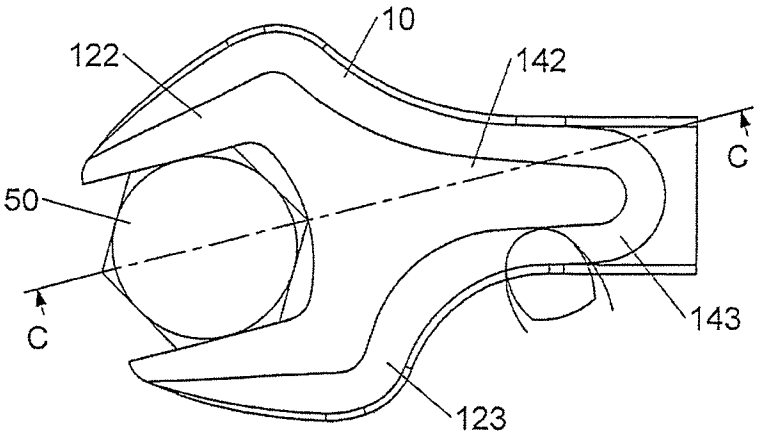
FIG. 9 shows that the open wrench of the present invention is worked on an object.

As shown in FIG. 9, when the driving portion 12 clamps and rotates the object 50, the thumb contacts the fourth layer 143 to easily apply a force to the open wrench.

Figure 10:
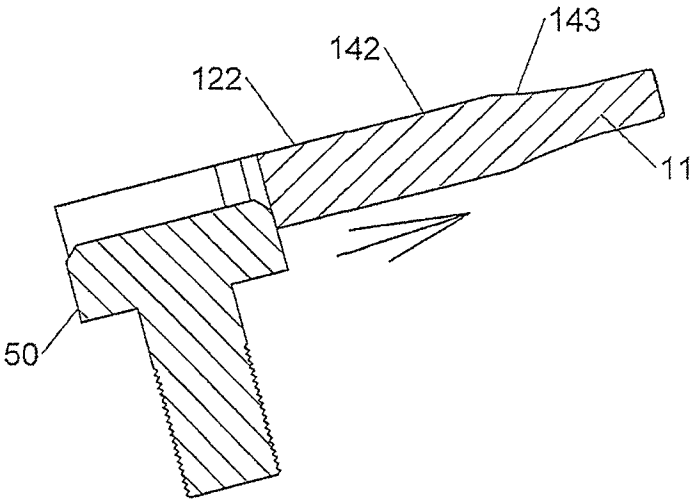
FIG. 10 is a cross sectional view taken along line C-C in FIG. 9.
Figure 21:
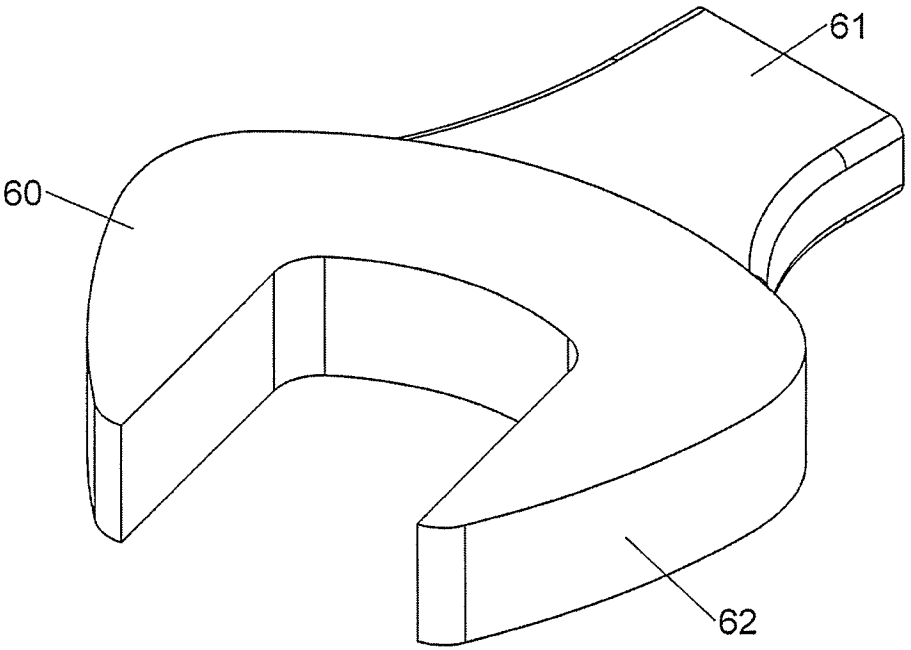
PRIOR ART FIG.21
FIG. 21 shows a conventional open wrench.
Figure 22:
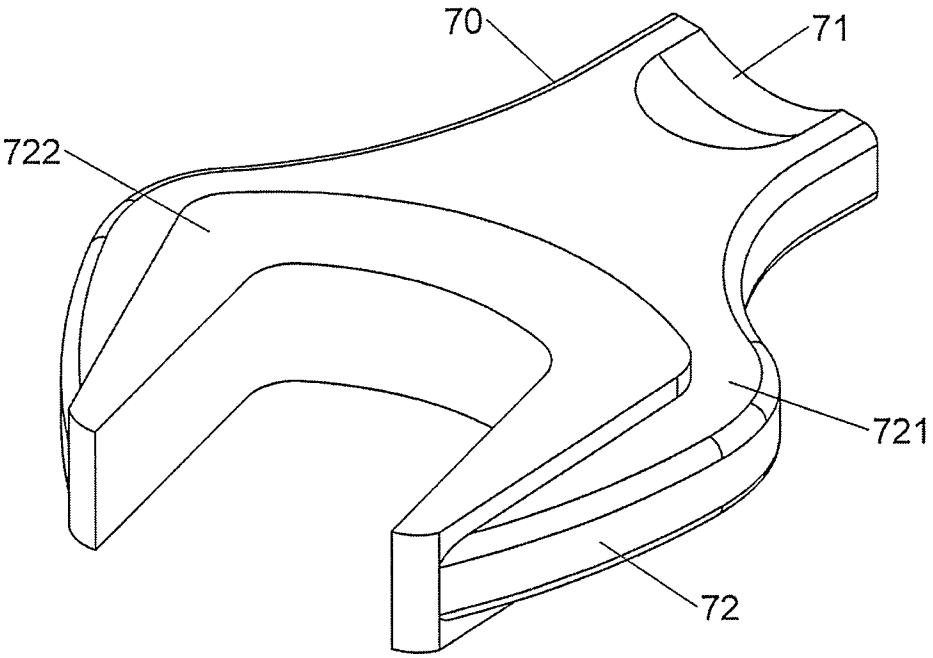
PRIOR ART FIG.22
FIG. 22 shows another conventional open wrench.

As shown in FIG. 10, when the driving portion 12 clamps and rotates the object 50, because other objects around the wrench, only a portion of the object 50 is accommodated in the opening 120, the torque is transferred to the handle 11 and the fourth layer 143 via the second layer 123. The driving portion 12 has the first, second, third and fourth layers 121, 123, 141, 143 so that it is lighter than the conventional driving portion 62 in FIG. 21, and is able to output a higher toque than the driving portion 72 in FIG. 22.

Figure 11:
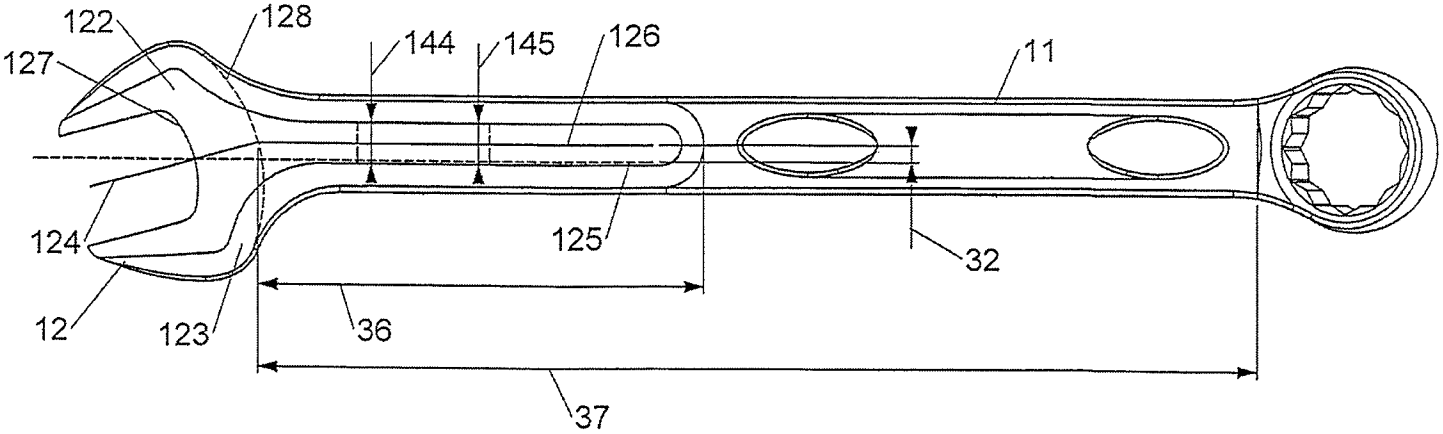
FIG. 11 is a top view of the second embodiment of the open wrench of the present invention.

As shown in FIG. 11, the second top face 142 extends to the middle portion of the handle 11 and along the axial line 126. The first and second widths 144, 145 are the same, and the second distance 36 is less than or equal to ½ of the third distance 37.

Figure 12:
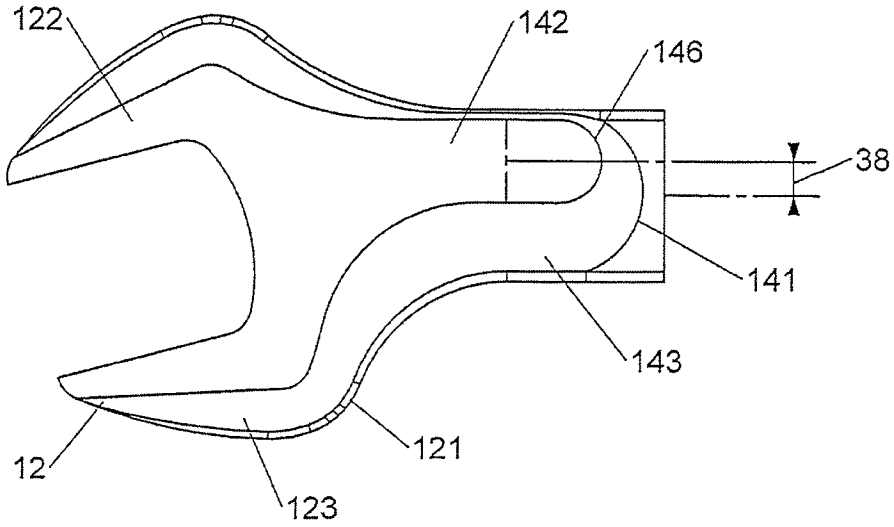
FIG. 12 is a top view of the driving portion of the third embodiment of the open wrench of the present invention.
Figure 13:
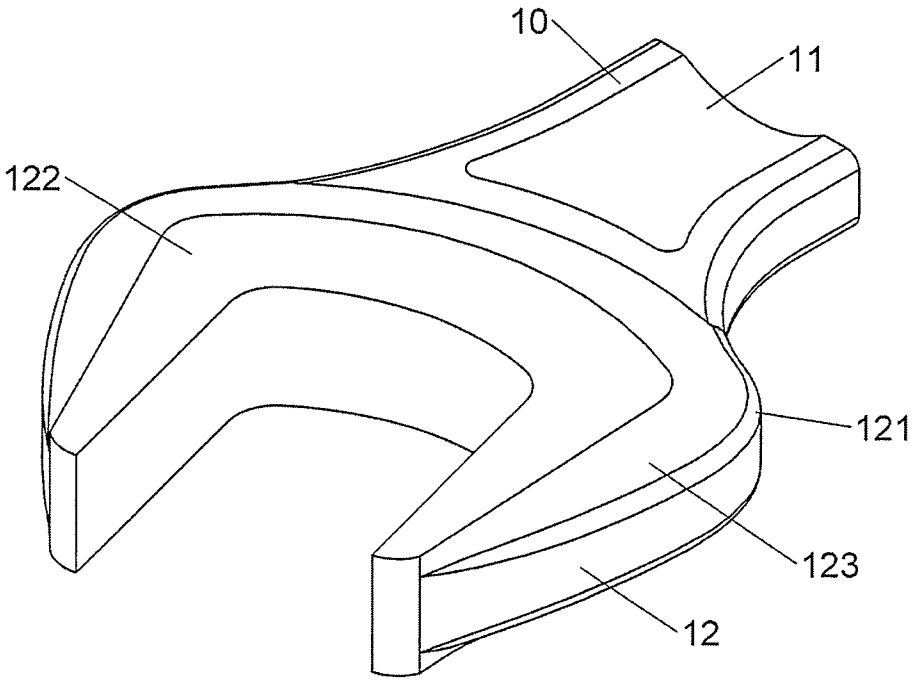
FIG. 13 is a perspective view of the driving portion of the fourth embodiment of the open wrench of the present invention.
Figure 15:
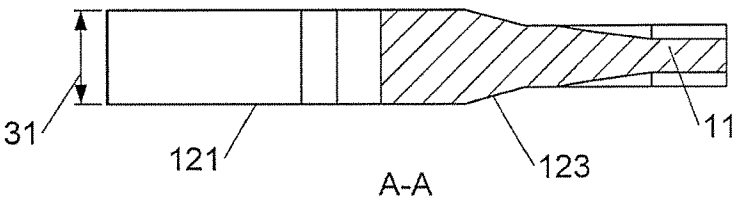
FIG. 15 is a cross sectional view taken along line A-A in FIG. 14.
Figure 14:
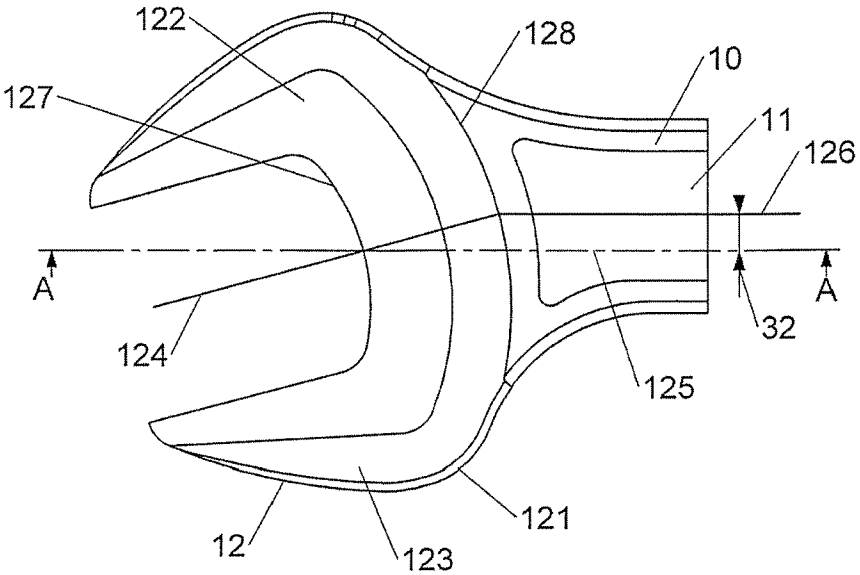
FIG. 14 is a top view of the driving portion of the fourth embodiment of the open wrench of the present invention.
Figure 16:
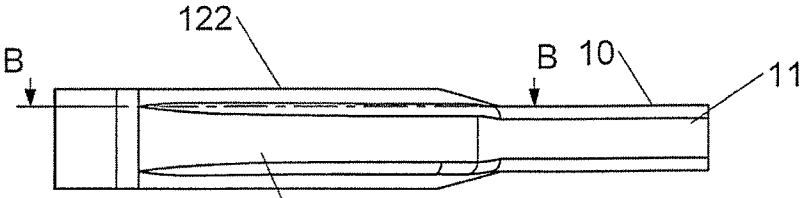
FIG. 16 is a side view of the driving portion of the fourth embodiment of the open wrench of the present invention.
Figure 17:
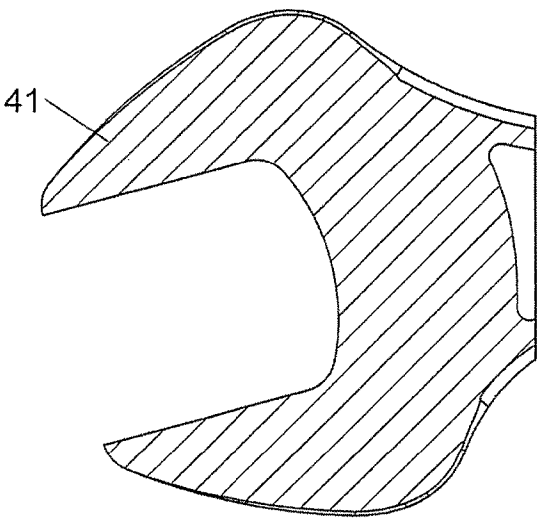
FIG. 17 is a cross sectional view taken along line B-B in FIG. 16.
Figure 18:
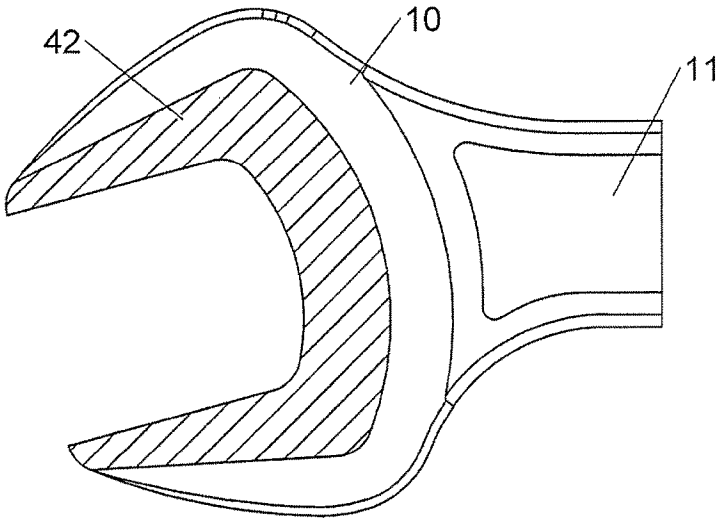
FIG. 18 is a cross sectional view of the top of the head of the fourth embodiment of the open wrench of the present invention.
Figure 20:
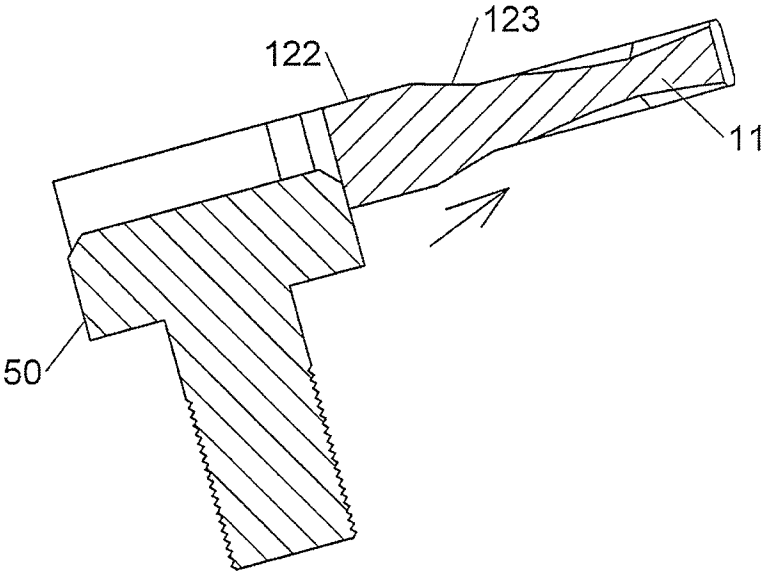
FIG. 20 is a cross sectional view taken along line C-C in FIG. 19.
Figure 19:
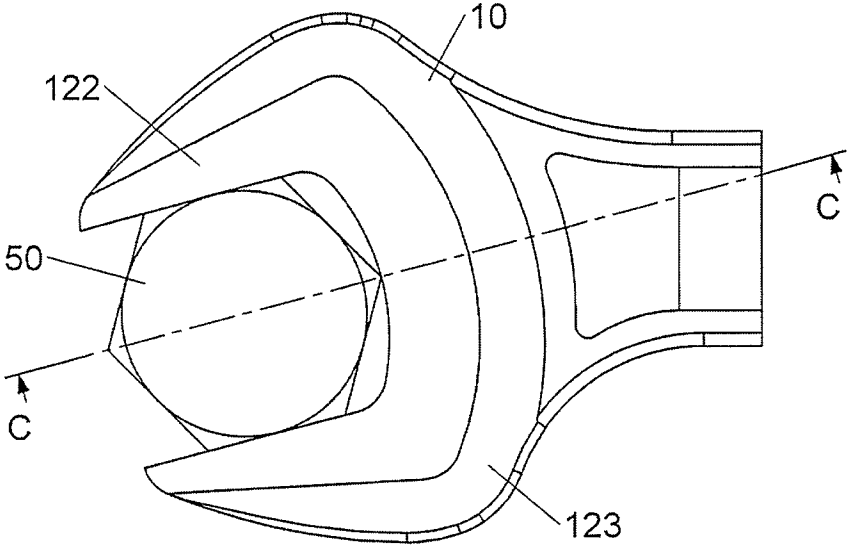
FIG. 19 shows that the fourth embodiment of the open wrench of the present invention is worked on an object.

As shown in FIG. 12, the second top face 142 is located close to one side of the handle 11. A gap 38 is defined between the central line of the second top face 142 and an axial line 126 of the handle 11.

As shown in FIGS. 13 to 20, the body 10 has only the first layer 121, the first top face 122 and the second layer 123. The third layer 141, the second top face 142 and the fourth layer 143 are omitted.

As shown in FIG. 1, the top of the first layer 121 to the lower end of the third layer 141 is a rounded side or an orthogonal side. The lower end of the second layer 123 to the first top face 122, and the lower end of the fourth layer 143 to the top face 142 is rounded side or an orthogonal side.

While we have shown and described the embodiment in accordance with the present invention, it should be clear to those skilled in the art that further embodiments may be made without departing from the scope of the present invention.

What is claimed is:

1. An open wrench comprising:

a head having a handle and a driving portion which has an opening defined through a front end, a top and a bottom of the head, a first layer and a second layer formed on each of the top and the bottom of the driving portion, the second layer formed on the first layer, the first and second layer located along the opening of the head, the second layer having a first top face defined in a top thereof, the first top face being a flat face, the first layer integrally formed on a flat face of the driving portion, a periphery of the second layer extending and connected to the first top face inclinedly, an area of the first top face being smaller than an area of a top of the first layer, a third layer extending from a middle portion of the first layer and toward the handle, a fourth layer extending from the second layer and toward the handle, the fourth layer having a second top face defined in a top thereof, the second top face extending toward the handle, the second top face being a flat face, the fourth layer integrally formed on the third layer, the third layer integrally formed on a flat face of the handle, a periphery of the fourth layer extending and connected to the second top face inclinedly, an area of the second top face being smaller than an area of a bottom of the third layer, and wherein an imaginary second curved face being formed at the connection between the first layer and the handle, a distance between an intersection point between an axial line of the handle and the second curved face to an intersection point between the axial line of the handle and a distal end of the fourth layer being defined as a second distance, and a ratio between the second distance to a length of the handle being less than 0.5.

2. The open wrench as claimed in claim 1, wherein the first and second top faces are located on a same plane and form a Y-shaped arrangement.

3. The open wrench as claimed in claim 1, wherein a cross sectional shape of the second layer has two sides and each side is a straight side.

4. The open wrench as claimed in claim 1, wherein a cross sectional shape of the fourth layer has two sides and each side is a curved side.

5. The open wrench as claimed in claim 1, wherein a cross sectional shape of the fourth layer has two sides and each side is a recessed and curved side.

6. The open wrench as claimed in claim 1, wherein the first top face is connected to the second top face at a portion thereof which has a first width, a middle portion of the second top face has a second width which is smaller than the first width, the second top face has a first curved portion formed at a distal end thereof, a diameter of the first curved portion is smaller than the second width, the distal end of the fourth layer has a second curved portion formed thereof, a diameter of the second curved portion is larger than the diameter of the first curved portion.

7. The open wrench as claimed in claim 6, wherein the first and second curved portions share a common center.

8. The open wrench as claimed in claim 1, wherein the second top face is located close to one side of the handle, a gap is defined between a central line of the second top face and the axial line of the handle.

9. The open wrench as claimed in claim 1, wherein a first distance is defined between the two respective first top faces of the top and bottom of the driving portion, the opening of the driving portion has a bisectional line, an angle of 15 degrees is defied between the bisectional line and the axial line of the handle, the opening has a first curved face defined in an inner end thereof, a reference line which is parallel to the axial line of the handle passes through a central point of the first curved face, the bisectional line intersects the axial line at the second curved face, a shift distance is formed between the reference line and the axial line.

10. The open wrench as claimed in claim 1, wherein an area of the first top face is ⅓ to ⅔ of an area of a top of the first layer.

11. The open wrench as claimed in claim 1, wherein the ratio is between ⅓~⅙.

* * * * *